US010217584B2

(12) United States Patent
Jing

(10) Patent No.: US 10,217,584 B2
(45) Date of Patent: Feb. 26, 2019

(54) MAGNETIC REED SWITCH

(71) Applicants: Deqiang Jing, Dongguan (CN); Dongguan Chuanqiang Electronic Technology Co., Ltd., Dongguan (CN)

(72) Inventor: Deqiang Jing, Dongguan (CN)

(73) Assignees: Deqiang Jing, Dongguan (CN); DONGGUAN CHUANQIANG ELECTRONIC TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 15/468,141

(22) Filed: Mar. 24, 2017

(65) Prior Publication Data

US 2017/0194119 A1 Jul. 6, 2017

Related U.S. Application Data

(63) Continuation-in-part of application No. PCT/CN2015/086789, filed on Aug. 12, 2015.

(30) Foreign Application Priority Data

Sep. 26, 2014 (CN) ..... 2014 1 0501337

(51) Int. Cl.
*H01H 36/00* (2006.01)

(52) U.S. Cl.
CPC ..... *H01H 36/0033* (2013.01)

(58) Field of Classification Search
CPC ..... H01H 36/0033; H01H 36/00; H01H 9/00; H01H 1/66
USPC ..... 335/151
See application file for complete search history.

(56) References Cited

U.S. PATENT DOCUMENTS 3,005,072 A * 10/1961 Brown ..... H01H 51/27 335/152
3,009,033 A * 11/1961 Werts ..... H01H 36/008 335/207
3,042,900 A * 7/1962 Werts ..... G11C 19/00 335/151
3,059,075 A * 10/1962 Peek, Jr. ..... H01H 51/27 335/154
3,061,696 A * 10/1962 Peek, Jr. ..... H01H 67/30 335/134
3,117,202 A * 1/1964 Werts ..... H01H 51/284 335/153
3,133,173 A * 5/1964 Vriens ..... H01H 36/0053 315/209 M
3,147,350 A * 9/1964 Lindley, Jr. ..... H01H 36/0053 335/2
3,158,710 A * 11/1964 Paglee ..... B65G 51/44 198/350

(Continued)

*Primary Examiner* — Shawki S Ismail
*Assistant Examiner* — Lisa N Homza
(74) *Attorney, Agent, or Firm* — Matthias Scholl P.C.; Matthias Scholl

(57) ABSTRACT

A magnetic reed switch, including: an insulating casing, magnetic reeds, and at least one flexible element. The insulating casing is a hollow structure. The magnetic reeds are disposed inside and at two ends of the insulating casing, respectively. Ends of the magnetic reeds overlap. The at least one flexible element is an electrically conductive material and is disposed on at least one magnetic reed. The at least one flexible element is connected in parallel to two ends of the magnetic reeds.

13 Claims, 4 Drawing Sheets

(56) References Cited

U.S. PATENT DOCUMENTS 3,158,761 A * 11/1964 Bullock ..... H01H 51/285 327/385
3,166,652 A * 1/1965 Werts ..... H01H 51/285 335/153
3,170,089 A * 2/1965 Zielinski ..... H01H 51/281 335/152
3,198,902 A * 8/1965 Deshautreaux, Jr. ... G01F 23/56 335/153
3,198,903 A * 8/1965 Chafee, Jr. ..... D06F 39/005 335/152
3,200,645 A * 8/1965 Levins ..... G01F 23/70 200/84 C
3,227,838 A * 1/1966 Hoeppel ..... H01H 36/0006 335/153
3,240,897 A * 3/1966 Anderson ..... H01H 11/005 335/154
3,251,962 A * 5/1966 Jones, Jr. ..... H01H 36/004 335/202
3,268,839 A * 8/1966 McFarland ..... H01H 51/281 335/151
3,270,161 A * 8/1966 Turner ..... H01H 51/287 335/151
3,284,740 A * 11/1966 Neapolitakis ..... F02P 3/0435 200/19.36
3,305,805 A * 2/1967 Tann ..... G01V 3/08 324/228
3,312,967 A * 4/1967 Levine ..... G09F 9/00 335/151
3,334,320 A * 8/1967 Frank ..... H01H 51/28 200/288
3,337,825 A * 8/1967 Brooks ..... H01H 36/0053 335/206
3,348,206 A * 10/1967 Dannatt ..... H01L 27/28 335/151
3,359,463 A * 12/1967 Jones, Jr. ..... H01H 51/281 335/127
3,388,463 A * 6/1968 Insley ..... H01H 11/005 29/407.1
3,390,362 A * 6/1968 Hoeppel ..... H01H 36/008 335/153
3,397,347 A * 8/1968 Hoeppel ..... G01F 23/70 324/207.13
3,397,348 A * 8/1968 Hoeppel ..... G01R 19/16509 324/244
3,440,583 A * 4/1969 Woodhead ..... H01H 36/0006 29/602.1
3,462,719 A * 8/1969 Peroni ..... H01H 1/5805 335/206
3,474,356 A * 10/1969 Hoffmann ..... H03H 7/24 333/262
3,477,046 A * 11/1969 Pigeon ..... H01H 19/62 335/190
3,477,047 A * 11/1969 Jeffery ..... H01H 36/006 335/206
3,478,287 A * 11/1969 Harrett ..... H01H 51/287 335/154
3,486,144 A * 12/1969 Paige ..... H01H 36/004 200/404
3,491,317 A * 1/1970 Harris, Jr. ..... H01H 36/004 335/205
3,505,869 A * 4/1970 Crawford ..... G01F 23/70 335/206
3,559,124 A * 1/1971 Posey ..... H01H 36/0013 335/205
3,570,004 A * 3/1971 De Jong ..... B23K 11/248 219/109
3,579,159 A * 5/1971 Posey ..... H01H 36/004 335/205
3,585,322 A * 6/1971 Jones, Jr. ..... H01H 36/0006 200/46
3,594,615 A * 7/1971 Cortelli ..... H01H 47/04 335/236
3,602,851 A * 8/1971 Wiegand ..... H01H 51/281 335/146
3,634,794 A * 1/1972 Verbeke ..... H01H 71/2445 335/153
3,701,960 A * 10/1972 Campbell ..... H01H 51/28 335/154
3,928,828 A * 12/1975 Kato ..... H01H 51/287 335/151
3,932,718 A * 1/1976 Porat ..... G08B 13/122 200/540
4,149,130 A * 4/1979 Lacis ..... H01H 51/287 335/154
4,210,889 A * 7/1980 Holce ..... H01H 36/0026 335/206
4,214,220 A * 7/1980 Queen ..... H01H 51/284 335/153
4,336,518 A * 6/1982 Holce ..... H01H 36/004 335/151
4,371,856 A * 2/1983 Holce ..... G01R 31/02 200/293
4,456,897 A * 6/1984 Holce ..... H01H 36/0033 335/202
4,479,117 A * 10/1984 Marquardt ..... H01H 50/08 307/116
4,536,754 A * 8/1985 Holce ..... G08B 13/149 335/207
4,788,534 A * 11/1988 Engelhardt ..... G01P 1/10 200/81.9 M
4,811,153 A * 3/1989 Sakatos ..... H01H 51/285 335/151
4,825,181 A * 4/1989 Nagano ..... B63C 9/21 335/205
4,877,927 A * 10/1989 Reneau ..... G01P 15/135 200/61.45 M
4,910,634 A * 3/1990 Pipkorn ..... G08B 13/08 200/50.1
4,922,369 A * 5/1990 Sakatos ..... H01H 51/285 335/151
4,943,791 A * 7/1990 Holce ..... H01H 36/0026 335/151
4,980,526 A * 12/1990 Reneau ..... G01P 15/135 200/61.45 M
5,128,641 A * 7/1992 Posey ..... H01H 36/002 335/151
5,155,460 A * 10/1992 Huckins ..... H01H 36/004 335/205
5,198,789 A * 3/1993 Taylor ..... H01H 50/541 335/132
5,233,322 A * 8/1993 Posey ..... H01H 36/002 335/151
5,293,523 A * 3/1994 Posey ..... H01H 36/002 335/151
5,422,616 A * 6/1995 Jackman ..... H01H 1/50 335/205
5,440,084 A * 8/1995 Fuse ..... G01P 15/135 200/61.45 M
5,629,659 A * 5/1997 Steiner ..... H01H 36/02 335/205
9,019,053 B1 * 4/2015 Contreras ..... H01H 3/08 335/154
2004/0032311 A1 * 2/2004 Forsythe ..... H01H 15/06 335/207
2005/0068133 A1 * 3/2005 Romanik ..... H01H 36/0033 335/207
2005/0077989 A1 * 4/2005 Edmonson, Jr. ... H01H 36/0013 335/207
2006/0238281 A1 * 10/2006 Steinberg ..... H01H 36/0013 335/207
2007/0279161 A1 * 12/2007 Lin ..... H01H 71/2445 335/14
2009/0237188 A1 * 9/2009 Christenson ..... H01H 1/66 335/151

* cited by examiner

MAGNETIC REED SWITCH

CROSS-REFERENCE TO RELATED APPLICATIONS

This application is a continuation-in-part of International Patent Application No. PCT/CN2015/086789 with an international filing date of Aug. 12, 2015, designating the United States, now pending, and further claims foreign priority benefits to Chinese Patent Application No. 201410501337.0 filed Sep. 26, 2014. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The invention relates to magnetic reed switch.

Description of the Related Art

A reed switch is an electrical switch operated by an applied magnetic field and typically includes two reeds. Ideally, the two reeds possess excellent magnetic properties and electrical conductivities. However, materials possessing such properties often have high electrical resistivity, leading to high resistance at the two ends of the reed switch and high heat generation. Thus, the current flowing through the reed switch is restrained, and generally does not exceed 5 A. This is unsatisfactory for many applications.

SUMMARY OF THE INVENTION

In view of the above-described problems, it is one objective of the invention to provide a magnetic reed switch that has a load current that is much larger than that of conventional reed switches.

To achieve the above objective, in accordance with one embodiment of the invention, there is provided a magnetic reed switch. The magnetic reed switch comprises an insulating casing and magnetic reeds. The magnetic reeds are provided with multiple soft metal conductive lines comprising a conductive metal material, or conductive layers comprising a conductive material. The multiple soft metal conductive lines are connected in parallel to two ends of the magnetic reeds, thus greatly reducing the resistance of the magnetic reeds, and increasing the load current of the magnetic reeds.

In a class of this embodiment, the magnetic reed switch comprises the insulating casing and the magnetic reeds. The insulating casing is a hollow structure. The magnetic reeds are disposed inside and at two ends of the insulating casing, respectively. Ends of the magnetic reeds overlap and a certain gap is disposed therebetween. Electric contacts are disposed at overlapping end faces of the magnetic reeds and coated with a layer of noble metal, such as rhodium or ruthenium. In a normal state, a gap exists between the electric contacts and the two electric contacts are in a disconnected state. The magnetic reeds comprise primary structural parts made of soft magnetic materials. Two ends of the at least one flexible element are respectively melted with two ends of movable contact magnetic reeds by welding; and welding joints at one end of the at least one flexible element are melted together with the electric contacts, respectively. The magnetic reeds are tightly combined with two end faces of the insulating casing to form a sealing structure inside the insulating casing. The sealing structure inside the insulating casing is filled with an inert gas to prevent the electric contacts from being oxidized.

Advantages of the magnetic reed switch according to embodiments of the invention are summarized as follows: the magnetic reed switch has excellent magnetic property as well as low conduction resistance, and is capable of bearing a much larger load current.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing a magnetic reed switch are described below. It should be noted that the following examples are intended to describe and not to limit the invention.

The magnetic reed switches generally have two types, i.e., a normally open type (type A) and a switchable type (type C).

EXAMPLE 1

Figure 1:
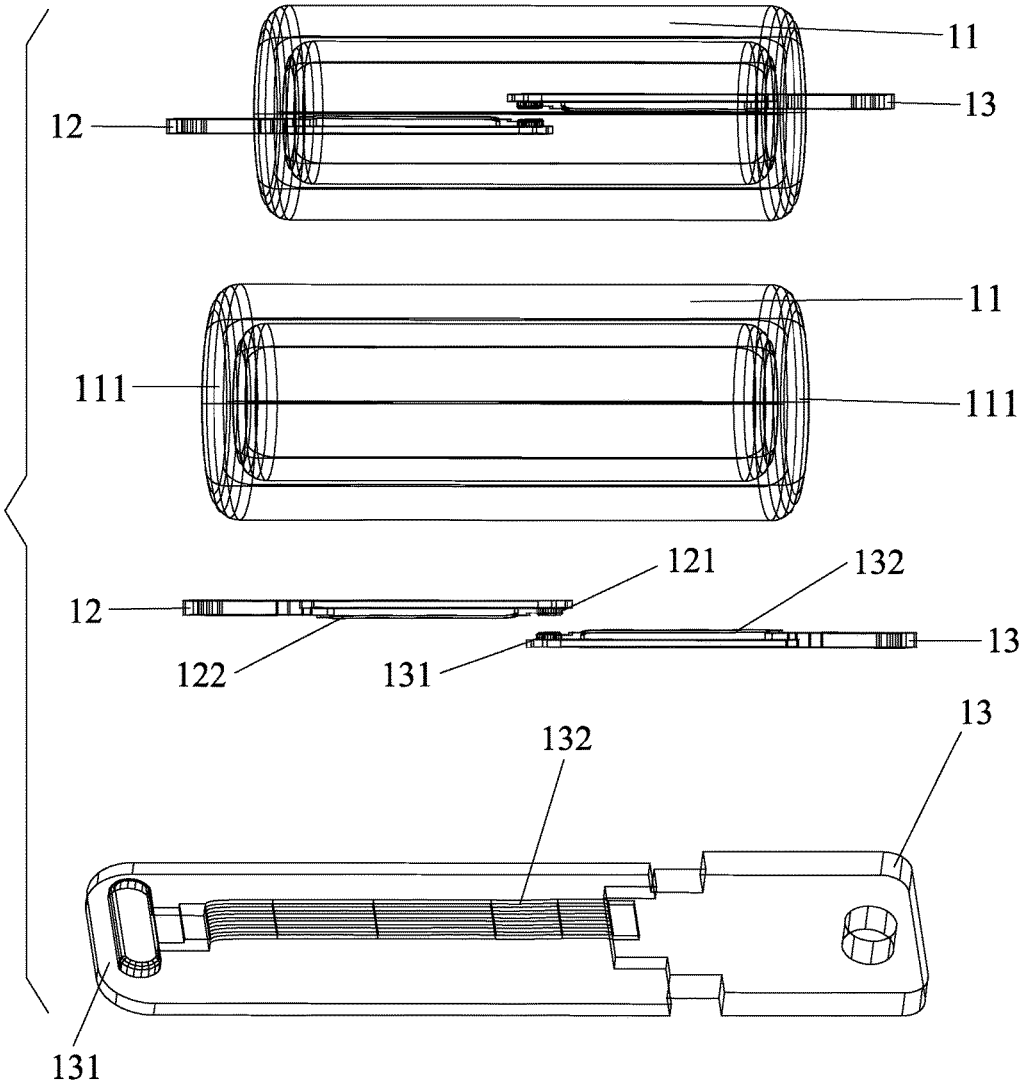
FIG. 1 is a structure diagram of a magnetic reed switch in accordance with Example 1.

A normally open type (type A) large current magnetic reed switch is illustrated in FIG. 1. The magnetic reed switch comprises: an insulating casing 11, a first movable contact magnetic reed 12, and a second movable contact magnetic reed 13. The insulating casing 11 is a hollow structure, the first movable contact magnetic reed 12 and the second movable contact magnetic reed 13 are disposed inside the insulating casing 11 at two ends thereof. The first movable contact magnetic reed 12 and the second movable contact magnetic reed 13 overlap at middle parts and a certain gap is disposed therebetween. A first electric contact 121 and a second electric contact 131 are disposed at two opposite end faces of overlapping regions of the first movable contact magnetic reed 12 and the second movable contact magnetic reed 13. The first electric contact 121 and the second electric contact 131 are coated with a noble metal, such as rhodium or ruthenium. In a normal state, a gap exists between the first electric contact 121 and the second electric contact 131 and the two electric contacts are disconnected. The first movable contact magnetic reed 12 and the second movable contact magnetic reed 13 comprise primary structural parts made of soft magnetic materials, featuring excellent magnetic properties and high elastic strength. Flexible elements 122, 132 made of conductive materials are respectively melted with two ends of the first and the second movable contact magnetic reeds 12, 13 by welding; and welding joints at one end of the at least one flexible element are melted together with the first and the second electric contacts 121, 131, respectively. The first movable contact magnetic reed 12 and the second movable contact magnetic reed 13 are tightly combined with two end faces 111 of the insulating casing 11 to form a sealing structure inside the insulating casing 11. The sealing structure inside the insulating casing 11 is filled with an inert gas to prevent the first electric contact 121 and the second electric contact 131 from being oxidized.

EXAMPLE 2

Figure 2:
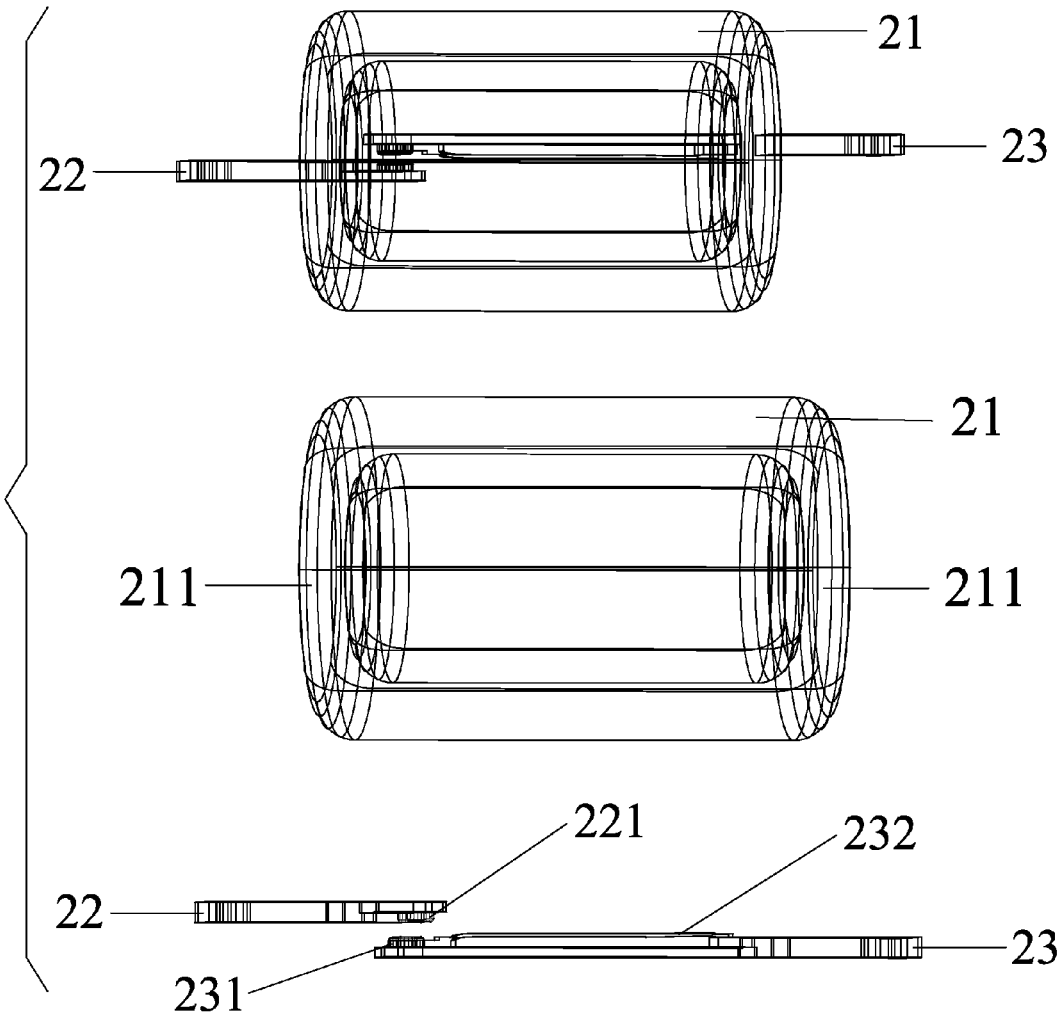
FIG. 2 is a structure diagram of a magnetic reed switch in accordance with Example 2.

A normally open type (type A) large current magnetic reed switch is illustrated in FIG. 2. The magnetic reed switch comprises: an insulating casing 21, a static contact magnetic reed 22, and a movable contact magnetic reed 23. The insulating casing 21 is a hollow structure, the static contact magnetic reed 22 and the movable contact magnetic reed 23 are disposed inside the insulating casing 21 at two ends thereof. Ends of the static contact magnetic reed 22 and the movable contact magnetic reed 23 overlap and a certain gap is disposed therebetween. A first electric contact 221 and a second electric contact 231 are disposed at two opposite end faces of overlapping regions of the static contact magnetic reed 22 and the movable contact magnetic reed 23. The first electric contact 221 and the second electric contact 231 are coated with a noble metal, such as rhodium or ruthenium. In a normal state, a gap exists between the first electric contact 221 and the second electric contact 231 and the two electric contacts are disconnected. The static contact magnetic reed 22 is made of a soft magnetic material, featuring excellent magnetic properties and high elastic strength, having a surface coated with an electrically conductive material by melting. The movable contact magnetic reed 23 has a primary structural part made of a soft magnetic material, featuring excellent magnetic properties and high elastic strength, two ends of a flexible element 232 are respectively melted with two ends of the movable contact magnetic reed 23 by welding; and a welding joint at one end of the flexible element is melted together with the second electric contact 231. The static contact magnetic reed 22 and the movable contact magnetic reed 23 are tightly combined with two end faces 211 of the insulating casing 21 to form a sealing structure inside the insulating casing 21. The sealing structure inside the insulating casing 21 is filled with an inert gas to prevent the first electric contact 221 and the second electric contact 231 from being oxidized.

The flexible element 232 is multiple soft metal conductive lines comprising a conductive metal material.

EXAMPLE 3

Figure 3:
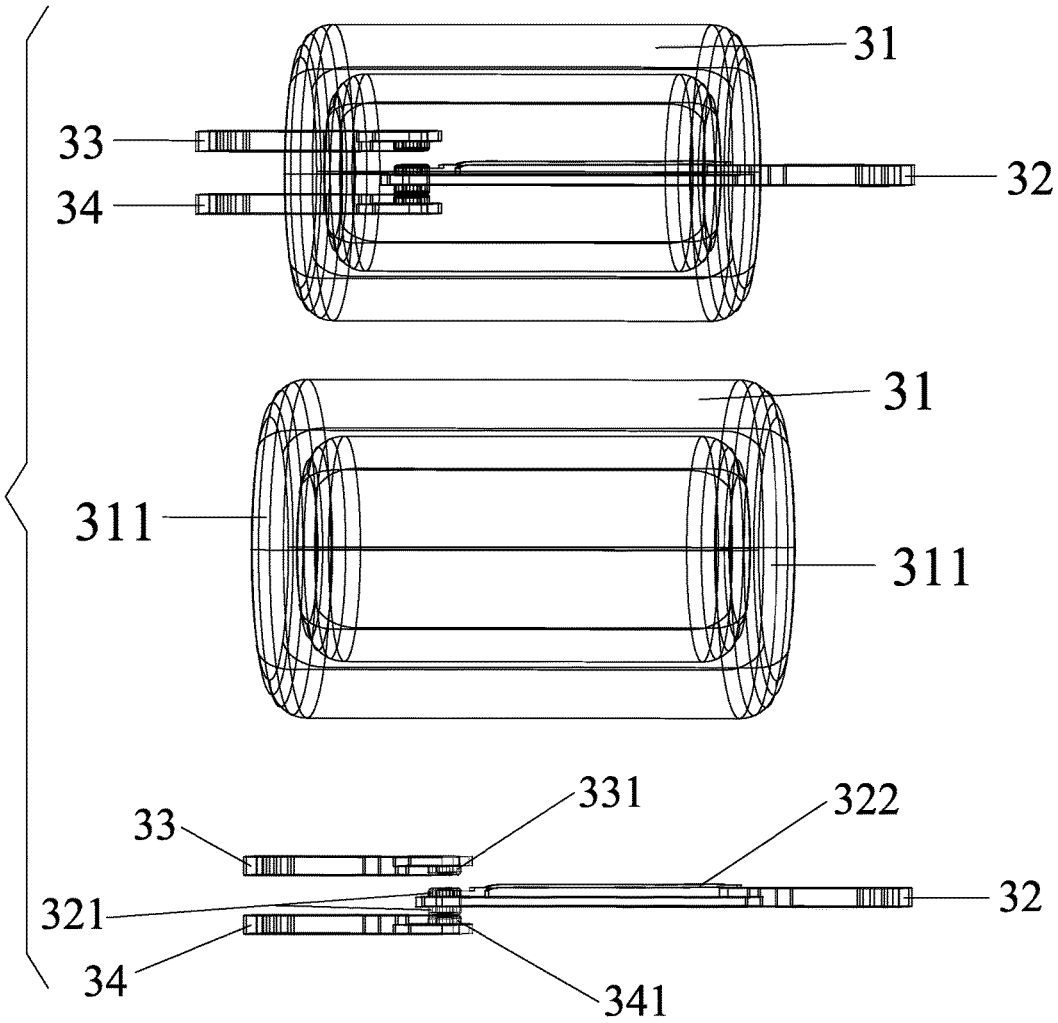
FIG. 3 is a structure diagram of a magnetic reed switch in accordance with Example 3.
Figure 4:
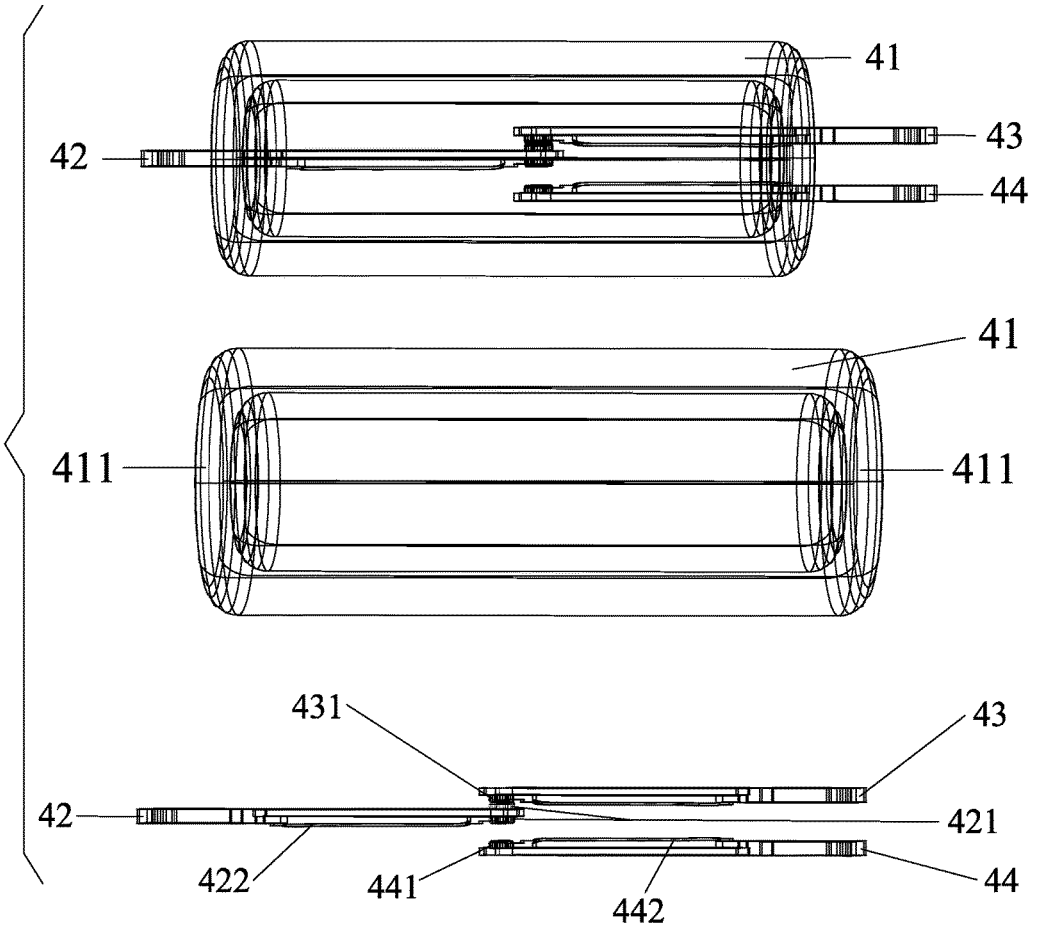
FIG. 4 is a structure diagram of a magnetic reed switch in accordance with Example 4.

A switchable type (type C) large current magnetic reed switch is illustrated in FIG. 3. The magnetic reed switch comprises: an insulating casing 31, a first static contact magnetic reed 33, a second static contact magnetic reed 34, and a movable contact magnetic reed 32. The insulating casing 31 is a hollow structure, the movable contact magnetic reed 32, the first static contact magnetic reed 33, and the second static contact magnetic reed 34 are disposed inside the insulating casing 31 at two ends thereof. Ends of the first static contact magnetic reed 33, the second static contact magnetic reed 34, and the movable contact magnetic reed 32 overlap and a certain gap is disposed therebetween. A first electric contact 331 and a third electric contact 321 are disposed at two opposite end faces of overlapping regions of the first static contact magnetic reed 33 and the movable contact magnetic reed 32. The first electric contact 331, a second electric contact 341, and third electric contacts 321 are coated with a noble metal, such as rhodium or ruthenium. In a normal state, a gap exists between the first electric contact 331 and third electric contacts 321 and the two electric contacts are disconnected. The second static contact magnetic reed 34 and the first static contact magnetic reed 33 are mounted at the same end and form a mirror image relative to the movable contact magnetic reed 32. One of the third electric contacts 321 and the second electric contact 341 are in contact for electrically connection in the normal state. The second static contact magnetic reed 34 is totally made of a non-soft magnetic material having excellent conductive performance The first static contact magnetic reed 33 is made of a soft magnetic material, featuring excellent magnetic properties and high elastic strength, having a surface coated with an electrically conductive material by melting. The movable contact magnetic reed 32 has a primary structural part made of a soft magnetic material, featuring excellent magnetic properties and high elastic strength, two ends of a flexible element 322 are respectively melted with two ends of the movable contact magnetic reed 32 by welding; and a welding joint at one end of the flexible element is melted together with the third electric contacts 321. The first static contact magnetic reed 33, the second static contact magnetic reed 34, and the movable contact magnetic reed 32 are tightly combined with two end faces 311 of the insulating casing 31 to form a sealing structure inside the insulating casing 31. The sealing structure inside the insulating casing 31 is filled with an inert gas to prevent the first electric contact 331, the second electric contact 341, and the third electric contacts from being oxidized.

The flexible element 322 is multiple soft metal conductive lines comprising a conductive metal material.

EXAMPLE 4

A switchable type (type C) large current magnetic reed switch is illustrated in FIG. 3. The magnetic reed switch comprises: an insulating casing 41, a first movable contact magnetic reed 42, a second movable contact magnetic reed 43, and a third movable contact magnetic reed 44. The insulating casing 41 is a hollow structure, the first movable contact magnetic reed 42, the second movable contact magnetic reed 43, and the third movable contact magnetic reed 44 are disposed inside the insulating casing 41 at two ends thereof. Ends of the second movable contact magnetic reed 43, the third movable contact magnetic reed 44, and the first movable contact magnetic reed 42 overlap and a certain gap is disposed therebetween. A first electric contact 421 and a second electric contact 431 are disposed at two opposite end faces of overlapping regions of the first movable contact magnetic reed 42 and the second movable contact magnetic reed 43, and the two electric contacts contact with each other for electric connection in a normal state. The third movable contact magnetic reed 44 and the second movable contact magnetic reed 43 are mounted at the same end and form a mirror image relative to the first movable contact magnetic reed 42. A third electric contact 441 is disposed on the third movable contact magnetic reed 44 opposite to the first electric contact 421 of the first movable contact magnetic reed 42 and a gap exists between the third electric contact 441 and the first electric contact 421. The first electric contacts 421, the second electric contact 431, and the third electric contacts 441 are coated with a noble metal, such as rhodium or ruthenium. The second movable contact magnetic reed 43 is totally made of a non-soft magnetic material having excellent conductive performance The first movable contact magnetic reed 42 and the third movable contact magnetic reed 44 comprise primary structural parts made of a soft magnetic material, featuring excellent magnetic properties and high elastic strength, a first flexible element 422 and a third flexible element 442 are respectively melted with two ends of the first movable contact magnetic reed 42 and the third movable contact magnetic reed 44 by welding; and welding joints at one end of the at least one flexible element are melted together with the first electric contact 421, and the third electric contacts 441. The first movable contact magnetic reed 42, the second movable contact magnetic reed 43, and the third movable contact magnetic reed 44 are tightly combined with two end faces 411 of the insulating casing 41 to form a sealing structure inside the insulating casing 41. The sealing structure inside the insulating casing 41 is filled with an inert gas to prevent the first electric contacts 421, the second electric contact 431, and the third electric contact 441 from being oxidized.

The first flexible element 422 and the third flexible element 442 are multiple soft metal conductive lines comprising a conductive metal material.

EXAMPLE 5

The magnetic reed switch of this example is the same as that of Example 1 except that the flexible elements 122, 123 are respectively multiple soft metal conductive lines comprising a conductive metal material. The metal materials for the multiple soft metal conductive lines are preferably copper, silver, and gold.

The metal material for the multiple soft metal conductive lines is copper. Table 1 is comparison results of indicators between the conventional reed switch MKA50202 and the large current magnetic reed switch of this example, which adopt the same material for the reeds.

TABLE 1

| Indicators | Russian MKA50202 | Large current magnetic reed switch |
|---|---|---|
| Contact form | Type A | Type A |
| Contact rating | 250 W | 250 W |
| Max. switching voltage | 250 V | 250 V |
| Max. breakdown voltage | 700 V | 700 V |
| Max. switching current | 3.0 A | 10 A |
| Max. load current | 5 A | 20 A |
| Contact resistance | 150 mΩ (measured 80-120 mΩ) | 8-12 mΩ |
| Resonant frequency | 700 Hz | 200 Hz |

It is indicated from the comparison that the current borne by the large current magnetic reed switch of the invention is obviously increased.

Table 2 is a comparison of high-frequency impedance between the conventional reed switch MKA50202 and the large current magnetic reed switch of this example under high-frequency current, in which the materials for the two reeds are the same. It is obvious that the high-frequency impedance of the large current magnetic reed switch of this example is significantly smaller than the conventional reed switch MKA50202, thus the current overload capacity of the magnetic reed switch of this example is improved.

TABLE 2

| High-frequency impedance | Russian MKA50202 | Large current magnetic reed switch |
|---|---|---|
| Contact form | Type A | Type A |
| 0 Hz | 150 mΩ (measured 60-80 mΩ) | 8-12 mΩ |
| 100 Hz | 150 mΩ (measured 60-80 mΩ) | 8-15 mΩ |
| 1 kHz | 150 mΩ (measured 90-120 mΩ) | 10-18 mΩ |
| 10 kHz | 150 mΩ (measured 140-170 mΩ) | 14-22 mΩ |
| 100 kHz | 150 mΩ (measured 650-820 mΩ) | 26-38 mΩ |

In condition of ensuring equivalent volume of the switch structure of this example of the same specification, multiple soft conductive lines are arranged in parallel on the reed of the same area of the cross section, so as to greatly reduce the resistance of the reed without affecting the elastic strength of the reed, therefore greatly reduce the skin effect of the current of the reed, especially for the high-frequency current.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A magnetic reed switch, comprising:

an insulating casing; and magnetic reeds, each of the magnetic reeds comprising a first layer and a second layer, and the second layer comprising a plurality of metal conductive lines;

wherein the insulating casing is a hollow structure;

the magnetic reeds are disposed inside and at two ends of the insulating casing;

ends of the magnetic reeds overlap;

the first layer is a magnetic material;

two ends of the second layer are welded to two ends of the first layer, respectively; and the plurality of metal conductive lines are disposed parallel to one another along the magnetic reeds.

2. The magnetic reed switch of claim 1, wherein electric contacts are oppositely disposed at overlapping positions of the ends of the magnetic reeds.

3. The switch of claim 1, wherein a gap exists between the magnetic reeds; and the magnetic reeds are movable contact magnetic reeds.

4. The switch of claim 1, wherein the magnetic reeds comprise a static contact magnetic reed and a movable contact magnetic reed;

ends of the static contact magnetic reed and the movable contact magnetic reed overlap and a certain gap is disposed therebetween;

the static contact magnetic reed is made of a soft magnetic material having a surface coated with an electrically conductive material by melting;

the movable contact magnetic reed has a primary structural part made of a soft magnetic material, two ends of the at least one flexible element are respectively melted with two ends of the movable contact magnetic reed by welding; and a welding joint at one end of the at least one flexible element is melted together with an electric contact of the movable contact magnetic reed.

5. The switch of claim 4, wherein the at least one flexible element is multiple soft metal conductive lines comprising a conductive metal material.

6. The switch of claim 1, wherein the magnetic reeds comprise two static contact magnetic reed and a movable contact magnetic reed disposed therebetween;

ends of the movable contact magnetic reed and one of the static contact magnetic reeds overlap and a certain gap is disposed therebetween;

each of the two static contact magnetic reed has a primary structural part made of a soft magnetic material, and a surface of the primary structural part is coated with an electrically conductive material by melting; and the movable contact magnetic reed comprises a soft magnetic material, two ends of the at least one flexible element are respectively melted with two ends of the movable contact magnetic reed by welding, and a welding joint at one end of the at least one flexible element is melted together with an electric contact of the movable contact magnetic reed.

7. The switch of claim 6, wherein one of the two static contact magnetic reeds is made of a non-soft magnetic material.

8. The switch of claim 7, wherein the at least one flexible element is multiple soft metal conductive lines comprising a conductive metal material.

9. The switch of claim 6, wherein the at least one flexible element is multiple soft metal conductive lines comprising a conductive metal material.

10. The switch of claim 1, wherein the magnetic reeds comprise three movable contact magnetic reeds;

a first movable contact magnetic reed is disposed between a second and a third movable contact magnetic reeds;

the three movable contact magnetic reeds overlap, and a gap is disposed between the first movable contact magnetic reed and the third movable contact magnetic reeds;

each of the first and the third movable contact magnetic reeds has a primary structural part made of a soft magnetic material;

two ends of each of flexible elements are respectively melted with two ends of each of the first and the third movable contact magnetic reed by welding; and a welding joint at one end of each of the flexible elements is melted together with electric contacts of movable contact magnetic reeds.

11. The switch of claim 10, wherein the second movable contact magnetic reed is made of a non-soft magnetic material.

12. The switch of claim 11, wherein the at least one flexible element is multiple soft metal conductive lines comprising a conductive metal material.

13. The switch of claim 10, wherein the at least one flexible element is multiple soft metal conductive lines comprising a conductive metal material.

* * * * *